US007419231B2

(12) United States Patent
Parish et al.

(10) Patent No.: US 7,419,231 B2
(45) Date of Patent: Sep. 2, 2008

(54) POWER SENSING CIRCUIT

(75) Inventors: George K. Parish, Winchester, KY (US); Kristi M. Rowe, Richmond, KY (US)

(73) Assignee: Lexmark International, Inc., Lexington, KY (US)

( * ) Notice: Subject to any disclaimer, the term of this patent is extended or adjusted under 35 U.S.C. 154(b) by 377 days.

(21) Appl. No.: 11/136,832

(22) Filed: May 25, 2005

(65) Prior Publication Data

US 2006/0268041 A1 Nov. 30, 2006

(51) Int. Cl.
*B41J 29/38* (2006.01)

(52) U.S. Cl. ..... 347/5; 347/9; 347/211

(58) Field of Classification Search ..... 347/5, 347/9, 12, 14
See application file for complete search history.

(56) References Cited

U.S. PATENT DOCUMENTS 4,453,166 A 6/1984 Enoto
4,595,935 A 6/1986 Brooks et al.
4,769,657 A 9/1988 Takahashi
4,813,802 A 3/1989 Gilham et al.
5,546,112 A 8/1996 Hunter et al.
5,736,997 A 4/1998 Bolash et al.
5,815,179 A 9/1998 Silverbrook
6,081,280 A * 6/2000 Bolash et al. ..... 347/9
6,183,056 B1 * 2/2001 Corrigan et al. ..... 347/14
6,481,814 B2 11/2002 Demoor et al.
6,520,615 B1 2/2003 Beck et al.
6,531,882 B2 3/2003 Morikawa et al.
6,616,256 B1 9/2003 Cook et al.
6,760,053 B2 7/2004 Rother
6,796,631 B2 9/2004 Kojima
2001/0033305 A1 10/2001 Tamura
2003/0132988 A1 7/2003 Beck et al.

* cited by examiner

*Primary Examiner*—Lam S Nguyen
(74) *Attorney, Agent, or Firm*—Michael Best & Friedrich, LLP

(57) ABSTRACT

A heater chip that includes a circuit element, and a bus that can be used to power the circuit element. The heater chip also includes a feedback circuit that is coupled to the power bus. Particularly, the feedback circuit can be configured to indicate if the bus is powered the circuit element.

4 Claims, 4 Drawing Sheets

POWER SENSING CIRCUIT

BACKGROUND

Embodiments of the invention generally relate to a printing apparatus, and particularly to a heater chip of the printing apparatus.

Conventional ink jet printing apparatus typically include one or more printheads in which ink is stored. The printheads have one or more ink reservoirs in fluid communication with nozzles through which ink exits the printhead toward a print medium. In many cases, the nozzles are located in one or more nozzle plates coupled to a body of the printhead. Each nozzle plate can be or include a heater chip having heat transducers or heaters that heat and vaporize the ink, thereby ejecting the ink from the nozzles.

The heater chips typically include logic circuitry, a plurality of power transistors, and a set of heating elements, heaters, or resistors. A hardware or software printer driver will selectively address, power, or energize the logic circuitry via a network of power connections such that the appropriate heating elements, heaters, or resistors are powered, addressed, actuated, energized, or heated for printing. In some heater chip designs, memory is used to address or energize the heating elements, heaters, or resistors. The memory can also be used to determine if the printhead is a monochrome printhead, a color printhead or a photograph quality printer printhead. A thermal ink jet printhead generally includes a network of ejection devices that are generated by joining a heater chip and a nozzle member. When energized, the heater chip fires a droplet of ink. The nozzle member is typically configured to focus the energy and direction of the droplet such that the ink droplet can be precisely located.

SUMMARY

If a heating element or a circuit element is disconnected from a corresponding network of power connections or busses, the corresponding heating element or the circuit element can fail to vaporize the ink or to operate. For example, if a power bus is configured to supply power to a set of heating elements, a bad connection at the power bus can lead to a failure of the heating elements to fire the droplet of ink.

To ensure that the circuit element or the heating element of the printhead are being powered or energized and being heated, some aspects of the heater chip such as its testability and reliability of the heater chip are often examined. For example, bi-directional communication between two incorporated electronic elements can enhance the testability, and thus, the reliability of both the elements. Accordingly, there is a need to provide an improved apparatus such that inadequate power connection between elements can be identified. In one form, the invention provides a heater chip that includes a circuit element, and a bus that can be used to power the circuit element. The heater chip also includes a feedback circuit that is coupled to the power bus. Particularly, the feedback circuit can be configured to indicate if the bus receives electrical signals to activate the circuit element.

In another form, the invention provides a heater chip that includes means for delivering operable to deliver power to a portion of the heater chip, and means for detecting if the means for delivering is delivering power to the portion of the heater chip.

In yet another form, the invention provides a heater chip that includes a power bus, and a resistive heating element that is connected to the power bus. The heater chip also includes a circuit that is mounted on the chip. The circuit has a feedback output that can be indicative of a condition of the power bus.

In yet another form, the invention provides an ink jet print cartridge that includes a heater chip, and a power bus on the heater chip. The ink jet print cartridge also includes a resistive heating element that is connected to the power bus, and a circuit that is mounted on the heater chip. The circuit includes a feedback output that can be used to indicate a condition of the power bus.

Overall, when a printer can be configured to determine a printhead status such as if the printhead is properly functioning, the printer can adequately operate or be able to compensate or adjust its operation in light of the printhead status. For example, if the printer determines that a power line on a CMOS heater chip or a primitive on an NMOS heater chip is not making a power connection such that a plurality of nozzles are not powered or are missing, the printer can perform a variety of functions such as notifying a user of the printer, and compensating the printer for the missing nozzles.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Embodiments of the invention relate to an apparatus for checking or determining or verifying a high-power connection path for open connections or shorts to ground. The high-power connection can include a connection from a printer to a heater chip, a connection through cabling, a connection between circuits, and a connection between bonds to the heater chip. In one embodiment, circuitry is added to a printhead to check, determine, or verify some or all of high voltage level connections, and to feed back the connection information to a printer, a printer controller, and the like.

Figure 1:
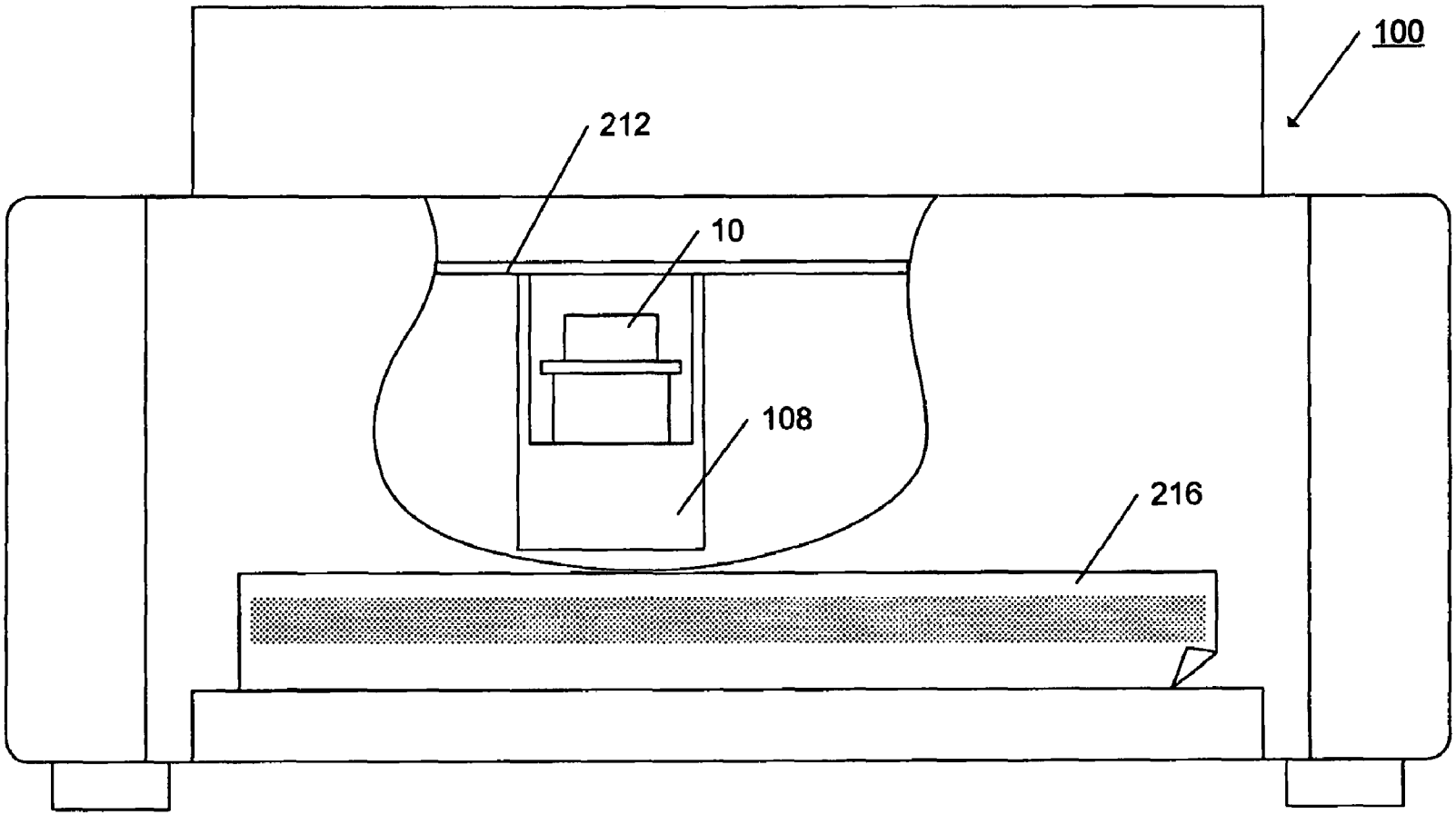
FIG. 1 shows a front view, partially broken away, of an ink jet printing apparatus having an ink jet printhead.

FIG. 1 shows a front view, partially broken away, of an ink jet printing apparatus 100, such as, but not limited to, an ink jet printer, an all-in-one device, a scanner, a copier, and the like. The ink jet printing apparatus 100 includes therein an ink jet print cartridge or an ink jet printhead 10 embodying the invention. A carriage system 108 supports the ink jet printhead 10, and a drive mechanism 212 moves the carriage system 108 and thus the ink jet printhead 10 back and forth to allow the ink jet printhead 10 to eject its ink onto a medium 216 provided below the ink jet printhead 10.

Figure 2:
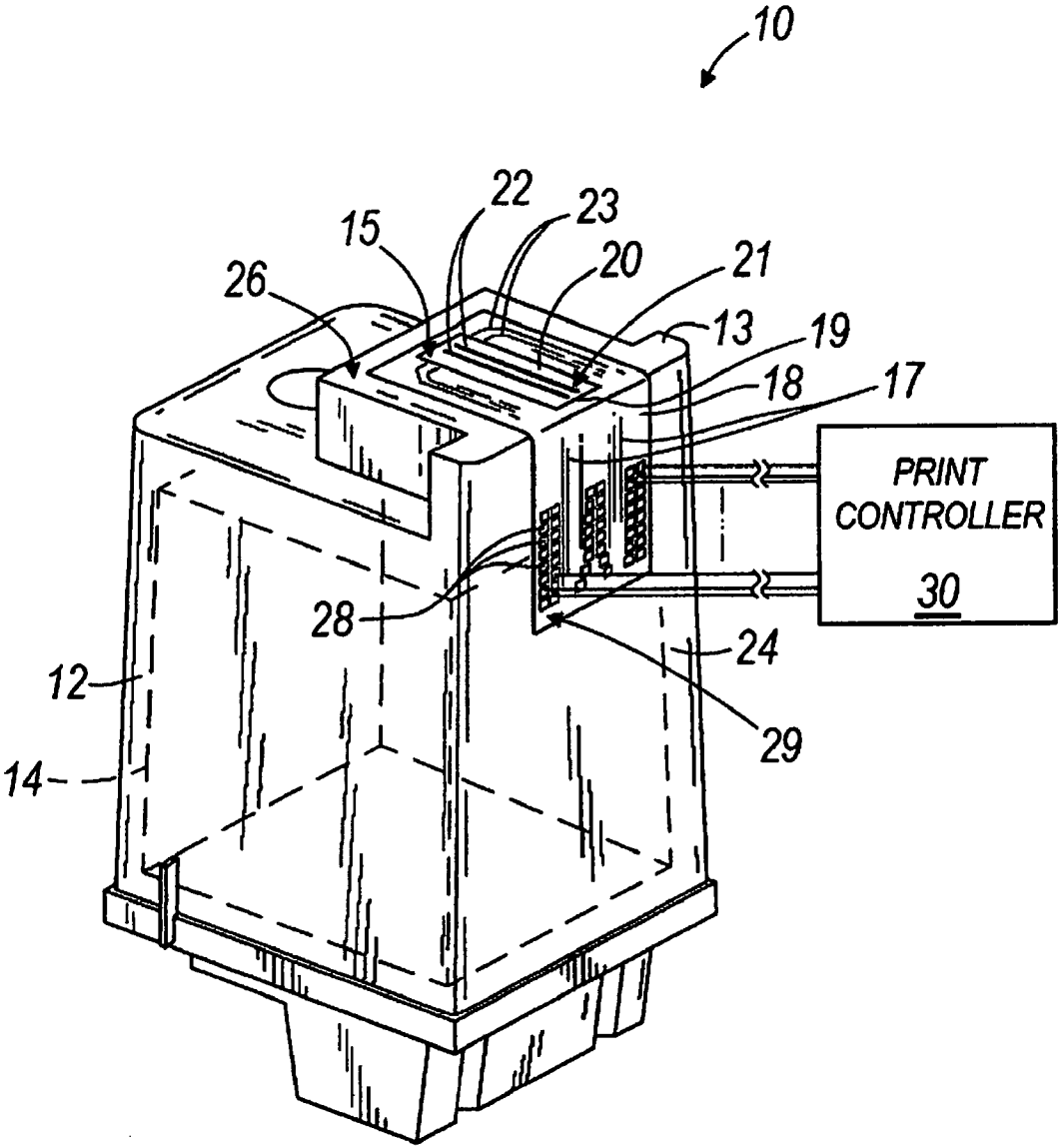
FIG. 2 shows a detailed view of the ink jet printhead of FIG. 1.

FIG. 2 illustrates an isometric view of the ink jet printhead 10 as shown in FIG. 1. The ink jet printhead 10 includes a housing 12 that defines a nosepiece 13 and an ink reservoir 14 containing ink or a foam insert saturated with ink. The housing 12 can be constructed of a variety of materials including, without limitation, one or a combination of polymers, metals, ceramics, composites, and the like. The ink jet printhead 10 illustrated in FIG. 2 has been inverted to illustrate a nozzle portion 15 of the ink jet printhead 10. The nozzle portion 15 is located at least partially on a bottom surface 26 of the nosepiece 13 for transferring ink from the ink reservoir 14 onto a print medium not shown. The nozzle portion 15 includes a heater chip 16 not visible in FIG. 2 and a nozzle plate 20 having a plurality of nozzles 22 that define a nozzle arrangement and from which ink drops are ejected onto printing media that is advanced through a printer not shown. The nozzles 22 can have any cross-sectional shape desired including, without limitation, circular, elliptical, square, rectangular, and any other shape that allows ink to be transferred from the printhead 10 to a printing medium. The heater chip 16 can be formed of a variety of materials including, without limitation, various forms of doped or non-doped silicon, doped or non-doped germanium, or any other semiconductor material. The heater chip 16 is positioned to be in electrical communication with conductive traces 17 provided on an underside of a tape member 18.

The heater chip 16 is hidden from view in the assembled printhead 10 illustrated in FIG. 2. As is commonly known in the art, the heater chip 16 is attached to the nozzle plate 20 in a removed area or cutout portion 19 of the tape member 18. The heater chip 16 is attached such that an outwardly facing surface 21 of the nozzle plate 20 is generally flush with and parallel to an outer surface 29 of the tape member 18 for directing ink onto a printing medium via the plurality of nozzles 22 in fluid communication with the ink reservoir 14. Although a thermal ink jet printing apparatus is used in the example, other types of ink jet technology such as piezoelectric technology can also be used with the invention.

Figure 3:
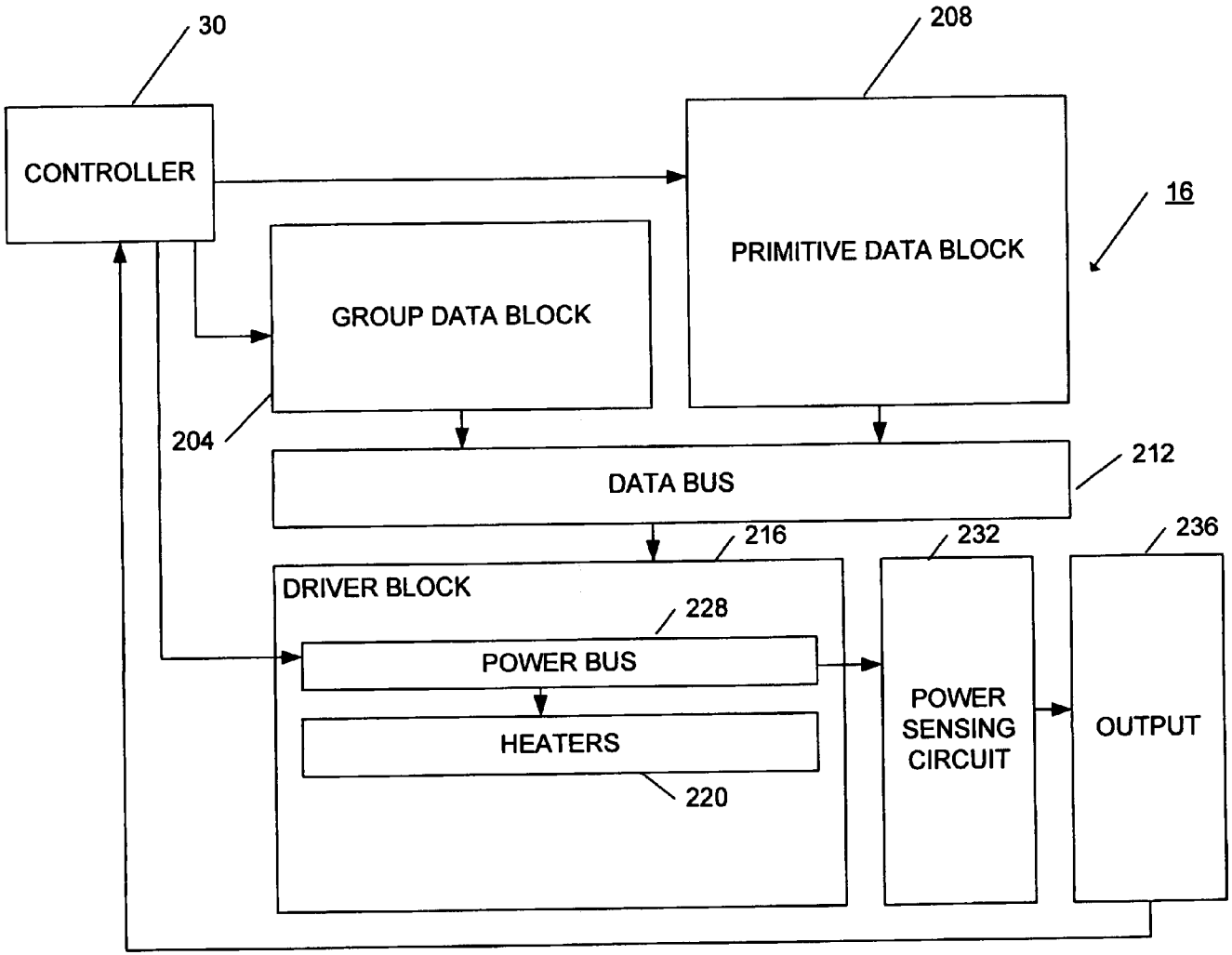
FIG. 3 illustrates an exemplary schematic diagram of a heater chip on the ink jet printhead of FIG. 2.

FIG. 3 illustrates a schematic block diagram of the heater chip 16. The heater chip 16 includes a group data block 204. The group data block 204 receives electronic signals such as image data, input data, and output data, and clock pulses from the controller 30 (of FIG. 2) of the printer 100. The group data block 204 also processes the signals with a plurality of shift registers, decoders and latches therein. The heater chip 16 also includes a primitive data block 208 that also receives electronic signals from the controller 30. The primitive data block 208 also includes a plurality of shift registers and latches. The outputs of the group data block 204 and the primitive data block 208 are fed to a data bus 212. The data bus 212 is coupled to a driver block 216 that is configured to heat, energize, or power some heaters of the heater chip 16. Particularly, the driver block 216 includes a plurality of heaters in a heater block 220. Each of the heaters in the heater block 220 is configured to be powered by a power source or by the controller 30 via a power bus 228. The driver block 216 can also include a plurality of drivers and logic circuitry. The power bus 228 is connected to a power sensing circuit 232 that senses a connection between the power bus 228 and the heater block 220. In some embodiments, the power sensing circuit 232 has an output 236 that can be used to indicate if power or electrical signals are supplied to the power bus 228. For example, the output 236 can be fed back to the print controller 30 or back to the printer 100 in some known manner. In some embodiments, the power sensing circuit 232 can include a passive voltage divider, or a power sensor. Among other things, the power sensing circuit 232 is configured to provide a way to feed back or indicate if power or electrical signals are being supplied to the power bus 228 and thus the heater block 220. In some embodiments, the electrical signals can be a voltage signal, or current signal. If the electrical signal supplied to the power bus 228 is a high-power voltage signal, the power sensing circuit 232 can divide the high-power voltage signal into a low voltage signal. In this way, the divided voltage signal can easily be fed back to the printer 100 or the print controller 30 for monitoring or verification. In some embodiments, the high-power voltage signal can range from about 9 to about 12 V, whereas the low voltage signal can range from about 3 to about 5 V.

Figure 4:
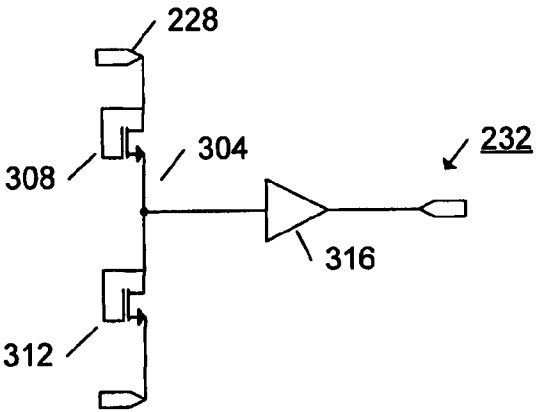
FIG. 4 shows a first embodiment of a power sensing circuit.

FIG. 4 shows a first embodiment of the power sensing circuit 232. The power sensing circuit 232, as shown in FIG. 4, includes an active divider circuit 304. The active divider circuit 304 receives power via the power bus 228 that also conveys the power to the heater block 220. In the embodiment shown in FIG. 4, the active divider circuit 304 includes transistors 308, 312 that are coupled to the power bus 228 (of FIG. 3) to receive power. The pair of transistors 308, 312 divides down the power received via the power bus 228 from a high voltage signal to an output signal such that the output signal can have an acceptable and lower voltage signal. In some embodiments, the acceptable and lower voltage can range from about 3 to about 5 V for some predetermined internal logic circuits, such as CMOS logic circuits. The output signal of the active divider circuit 304 is fed to a buffer 316 that can in turn be coupled back to the printer 100, or the printer controller 30. In some embodiments, the output of the buffer 316 includes a power sense bit that can be fed back through a scan test circuitry implemented in the heater chip 16. The power sense bit can also be fed back directly to the printer 100 (of FIG. 1), or to a serial output shift register of the heater chip 16 before being fed back to the printer 100.

The size of the heater chip 16 can be affected by the addition of the power sensing circuit 232. Depending on applications, the size of the power sensing circuit 232 can be considered as a part of the design of the heater chip 16. For example, the size of the power sensing circuit 232 or the active divider circuit 304 can be based on the size of the transistors 308, 312, or the size of the divider such that the power sensing circuit 232 or the active divider circuit 304 can divide the high-power voltage down to the acceptable voltage.

For another example, the size of the active divider circuit 304 can be adjusted or resized such that a leakage current via the transistors 308, 312 can be reduced. In some embodiments, a leakage current of about 20 μA is considered acceptable. Since the acceptable range of the leakage current can vary depending on the design or the applications at hand, the transistors 308, 312 can be adjusted accordingly.

For yet another example, the transistors 308, 312 can be adjusted such that the transistors 308, 312 can only occupy a predetermined amount of area on the heater chip 16. While the transistor 308, 312 can be sized to accommodate or allow small leakage current, or to occupy a predetermined area, the transistors 308, 312 can also be configured to operate at the high-power voltage, as described above, for the heater block 216. In some embodiments, the transistors 308, 312 can include lightly doped drain ("LDD") transistors. In some embodiments, the active divider circuit 304 can use similar power transistors that the heater chip 16 uses to drive the heater block 220.

Figure 5:
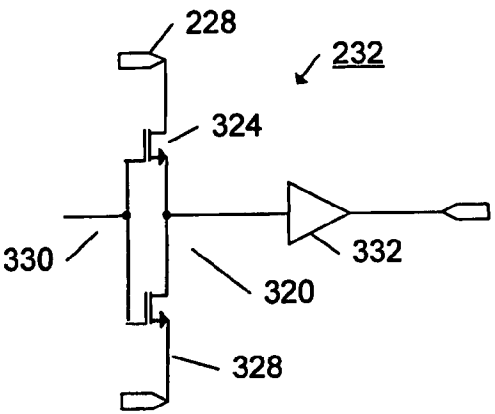
FIG. 5 shows a second embodiment of a power sensing circuit.

FIG. 5 shows a second embodiment of the power sensing circuit 232 that includes a second active divider circuit 320 to divide down the high-power voltage to the acceptable voltage, as described earlier. The second active divider circuit 320 can also be used to reduce or to minimize the leakage current through a pair of transistors 324, 328. The second active divider circuit 320 includes an enable/disable circuit 330 that can be used to enable or disable the transistors 324, 328. In the embodiment shown in FIG. 5, the enable/disable circuit 330 includes a connection from the controller 30 (of FIG. 3) to the transistor pair 324, 328. In this way, the transistors 324, 328 can be enabled during a test mode such that the output of the transistors 324, 328 is fed back to the test circuitry in the heater chip 16, and disabled otherwise. The second active divider circuit 320 also includes a logic buffer 332 that receives the divided voltage signal from the transistor pair 324, 328. The logic buffer 332 also outputs a power sense bit that can be fed back to the printer 100, the print controller 30, the test circuitry, or the serial output shift register before being fed back to the printer 100.

Figure 6:
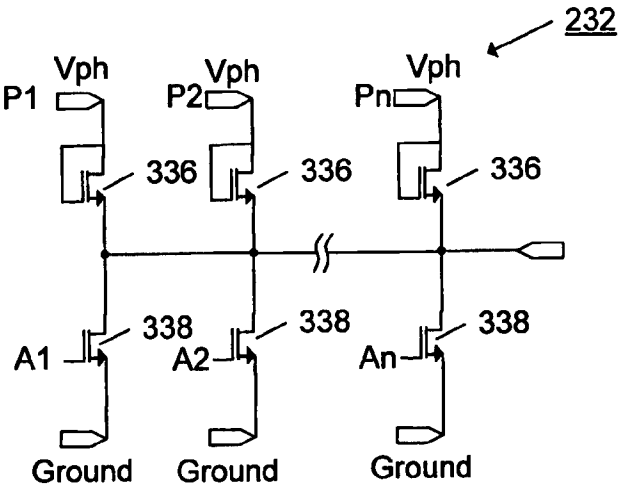
FIG. 6 shows yet a third embodiment of a power sensing circuit.

FIG. 6 shows yet a third embodiment of the power sensing circuit 232 that can be used to detect the power connections at NMOS chips that have other structures. Similar to FIG. 4, the third embodiment has a plurality of transistors 336, 338. The transistors 336 have a pull-up for each primitive ("P"), and the transistor 338 has a pull-down for each address ("A"). In some embodiments, a first primitive $P_1$ has an NMOS pull-up and a pull-down selectable by address A1. A second primitive $P_2$ will have a second NMOS pull-up and a second pull-down selectable by address A2. Although the third embodiment shows that each address has a corresponding primitive, a primitive can also be used for a plurality of addresses, or an address can be used for a plurality of primitives. The outputs of the transistor pairs 336, 338 can be tied together, since only one primitive and one address are selected at a time, for example during a test mode. Therefore, if the primitive is open or in an OPENED state, the output of the transistor pair 336, 338 will be pulled low, or near ground. However, if the address is open or in an OPENED state, the output of the transistor pair 336, 338 will be pulled up, near high or $V_{ph}$. If both the primitive and the address are closed or connected or in a CLOSED state, the output of the transistor pair 336, 338 will be near $V_{cc}$, or a ratio between the resistance of the transistor 336 and the resistance of the transistor 338.

Thus, the invention provides, among other things, a power sensing circuit operable to verify a power connection supplied to a circuit element of a heater chip. Various features and advantages of the invention are set forth in the following claims.

What is claimed is:

1. A heater chip comprising:

a circuit element;

a bus operable to power the circuit element; and a feedback circuit coupled to the bus, and operable to indicate if the bus receives electrical signals to activate the circuit element; and wherein the feedback circuit is operable to scale down the electrical signals supplied to the circuit element via the bus; and further wherein the feedback circuit comprises a primitive and an address, wherein the feedback circuit is operable to indicate a first value for the electrical signals when the primitive is in an OPEN state, a second value that is higher than the first value for the electrical signals when the address is in an OPEN state, and a third value that is between the first and the second values when both the primitive and the address are in a CLOSED state.

2. A heater chip comprising:

a circuit element;

a bus openable to power the circuit element; and means for detecting if the bus receives the electrical signals to activate the circuit element, wherein the means for detecting comprises means for scaling down an electrical signal supplied to the means for detecting; and further wherein the means for detecting comprises a primitive, and an address, wherein the means for detecting comprises means for indicating a first value for the electrical signal when the primitive is in an OPEN state, a second value that is higher than the first value for the electrical signal when the address is in an OPEN state, and a third value that is between the first and the second values when both the primitive and the address are in a CLOSED state.

3. A heater chip comprising:

a power bus;

a resistive heating element connected to the power bus; and a circuit mounted on the chip and including a feedback output indicative of a condition of the power bus, wherein the circuit is operable to scale down an electrical signal supplied to the circuit via the power bus; and further wherein the circuit comprises a primitive, and an address, wherein the circuit is operable to indicate a first value for the electrical signal when the primitive is in an OPEN state and a second value that is higher than the first value for the electrical signal when the address is in an OPEN state, and a third value that is between the first and the second values when both the primitive and the address are in a CLOSED state.

4. An ink jet printer comprising:

a heater chip;

a power bus on the heater chip;

a resistive heating element connected to the power bus; and a circuit mounted on the heater chip and including a feedback output indicative of a condition of the power bus, wherein the circuit is operable to scale down an electrical signal supplied to the circuit via the bus; and wherein the circuit comprises a primitive, and an address, wherein the circuit is operable to indicate a first value for the electrical signal when the primitive is in an OPEN state and a second value that is higher than the first value for the electrical signal when the address is in an OPEN state, and a third value that is between the first and the second values when both the primitive and the address are in a CLOSED state.

* * * * *